US009546838B2

(12) United States Patent
Liskey et al.

(10) Patent No.: US 9,546,838 B2
(45) Date of Patent: Jan. 17, 2017

(54) POROUS MATRIX SOUND SUPPRESSOR

(71) Applicant: Emporeum Plastics, LLC, Douglassville, PA (US)

(72) Inventors: Bradley Lee Liskey, Douglassville, PA (US); Ryan Steven Phillips, Coatsville, PA (US); Daniel Earl White, Conshohocken, PA (US)

(73) Assignee: Emporeum Plastics Corporation, Birdsboro, PA (US)

( * ) Notice: Subject to any disclaimer, the term of this patent is extended or adjusted under 35 U.S.C. 154(b) by 0 days.

(21) Appl. No.: 14/572,300

(22) Filed: Dec. 16, 2014

(65) Prior Publication Data

US 2015/0354422 A1 Dec. 10, 2015

Related U.S. Application Data

(60) Provisional application No. 62/009,732, filed on Jun. 9, 2014.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34; F41A 21/36; F41A 21/38; F01N 3/02
USPC ..... 89/14.1–14.4
See application file for complete search history.

(56) References Cited

U.S. PATENT DOCUMENTS

| | | | | |
|---|---|---|---|---|
| 3,040,662 | A * | 6/1962 | Zisman | F42B 14/02 102/527 |
| 4,454,798 | A * | 6/1984 | Shea | F41A 21/30 181/223 |
| 4,530,417 | A * | 7/1985 | Daniel | F41A 21/30 181/223 |
| 5,136,923 | A * | 8/1992 | Walsh, Jr. | F41A 21/30 89/14.2 |
| 5,293,708 | A * | 3/1994 | Strayer | F41A 9/70 42/7 |
| D415,813 | S | 10/1999 | O'Quinn et al. | |
| 6,079,311 | A | 6/2000 | O'Quinn et al. | |
| 6,298,764 | B1 * | 10/2001 | Sherman | F41A 21/34 89/14.2 |
| 6,796,214 | B2 | 9/2004 | Hausken et al. | |
| 7,530,299 | B1 * | 5/2009 | Poff | F41A 21/36 42/1.06 |
| 8,051,948 | B2 | 11/2011 | Geyer, III | |
| 8,104,570 | B2 | 1/2012 | Miller et al. | |
| 8,196,701 | B1 * | 6/2012 | Oliver | F41A 21/30 181/223 |

(Continued)

FOREIGN PATENT DOCUMENTS

| | | |
|---|---|---|
| WO | WO2014135639 A1 | 9/2014 |
| WO | WO2015083110 A1 | 6/2015 |

*Primary Examiner* — Stephen M Johnson
*Assistant Examiner* — Benjamin Gomberg
(74) *Attorney, Agent, or Firm* — Kathleen Kuznicki; Lynch Law Group, LLC

(57) ABSTRACT

Disclosed is a sound-suppressing device that employs a porous micro-channel diffusion matrix surrounding a hollow core tube that acts to exponentially increase the surface area of the suppressor and allow combustion gasses to diffuse and exit the suppressor across the entire outer surface of the suppressor.

6 Claims, 9 Drawing Sheets

(56) References Cited

U.S. PATENT DOCUMENTS

Figure 1:
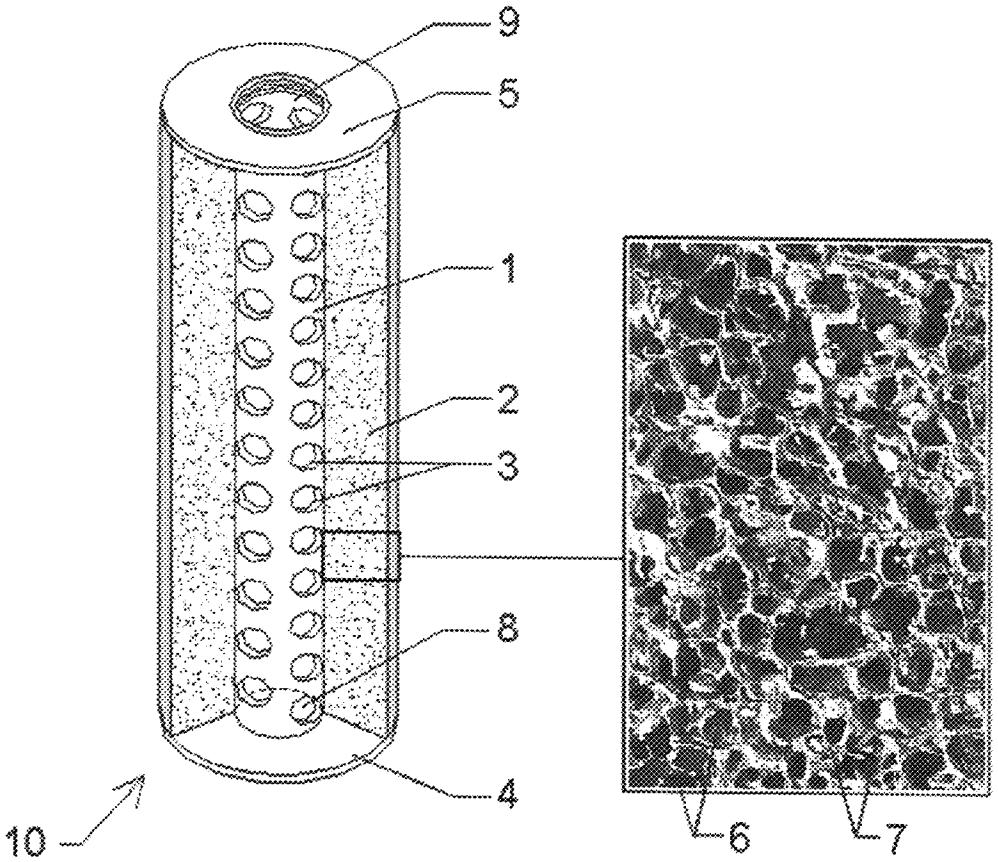

| | | | | |
|---|---|---|---|---|
| 8,579,075 | B2 | 11/2013 | Brittingham et al. | |
| 8,807,005 | B2 * | 8/2014 | Moss | F41A 21/24 181/223 |
| 9,102,010 | B2 * | 8/2015 | Wilson | B23K 26/345 |
| 2003/0145718 | A1 * | 8/2003 | Hausken | F41A 21/30 89/14.4 |
| 2007/0107590 | A1 * | 5/2007 | Silvers | F41A 21/30 89/14.4 |
| 2015/0001001 | A1 | 1/2015 | Wilson | |

* cited by examiner

POROUS MATRIX SOUND SUPPRESSOR

This application claims priority to provisional application No. 62/009,732 filed on Jun. 9, 2014, entitled Porous Matrix Sound Suppressor.

FIELD OF INVENTION

The invention pertains to a sound-suppressing device for reducing the magnitude of perceived sound that occurs during the discharge of a firearm. Specifically, it pertains to a device that employs a porous micro-channel, diffusion matrix surrounding a core tube, interposed between a distal containment cap and a proximal muzzle connection cap.

BACKGROUND OF INVENTION

Sound generation occurs when discharging a firearm. The sound heard is due to the following sources: the ignition of the cartridge; the discharge of propellant gas from the end of the barrel of a firearm, the flight of the bullet, the bullet impacting its target and the mechanical operation of the firearm itself. Multiple technologies can be employed to reduce the perceived sound associated with discharging a firearm. Typically, a suppressor (commonly known as a "silencer") is capable of reducing some of the sound emitted from discharging a firearm.

A suppressor generally takes the form of a cylindrically shaped metal tube with various internal mechanisms to reduce the sound of a discharge. The suppressor is typically made of metal (e.g. steel, aluminum, or titanium) that can withstand the heat and pressure associated with escaping propellant gasses. Previous suppressor designs utilize baffling of all shapes and sizes to trap, cool, and decompress gasses released by a firearm in a controllable manner. The baffling design reduces the energy of the gasses, and when the gasses exit the suppressor, the perceived audible signature of the weapon is significantly reduced. Some examples include U.S. Pat. Nos. 8,579,075, 8,104,570, and U.S. Pat. No. 6,079,311.

Traditional suppressor designs have drawbacks that make them undesirable or inconvenient for some users. Drawbacks of these traditional suppressors may include but are not limited to: altering the point of the bullet's impact on the target; adding significant weight to the firearm; increasing the blow back; having increased difficulties and increased costs associated with manufacturing intricate designs; changing the recoil of the firearm; increasing the barrel temperature of the firearm which gives the user a perceived mirage effect and decreases the effectiveness of suppressor, and difficulty in cleaning.

SUMMARY

This disclosure is directed to a suppression device that employs a porous micro-channel diffusion matrix surrounding the outer surface of a hollow core tube, replacing the traditional inner baffling, to diffuse, slow and cool gasses released from the discharge of a firearm; reducing the audible signature. As a bullet passes through the hollow core tube, propellant gasses are released though the vents of the hollow core tube and into the porous micro-channel diffusion matrix where the gasses are cooled, slowed, and diffused into the atmosphere. The porous micro-channel diffusion matrix is interposed between containment caps. At the distal end (with respect to the firearm's muzzle) is a containment cap and at the proximal end is a muzzle connection cap that connects the device to the end of the firearm barrel. The suppression device disclosed effectively reduces the audible signature associated with the discharge of a firearm as well as reducing the Hash associated with the release of combustion gasses out of the muzzle.

The advantages of the present invention are that it provides for a suppressor with a porous micro-channel diffusion matrix that:

(a) reduces the muzzle flash and the audible sound associated with the discharge of a firearm;

(b) exponentially increases the surface area of the suppressor when compared to traditional inner baffling designs, allowing combustion gasses to diffuse and exit the device across the entire outer surface of the suppressor rather than only through a single aperture located at the distal end;

(c) does not substantially change the point-of-impact of the bullet on its target;

(d) does not substantially increase the overall weight of the firearm;

(e) does not substantially increase blowback;

(f) does not substantially heat the barrel resulting in the mirage effect, a decreased barrel lifetime and in decreased efficiency of the suppressor; and (g) has a lower cost of manufacturing when compared to traditional suppressors.

SHORT DESCRIPTION OF THE FIGURES

FIG. 1: A cut out view of an embodiment of the suppressor device displaying a porous micro-channel diffusion matrix comprised of a metallic material.

Figure 2B:
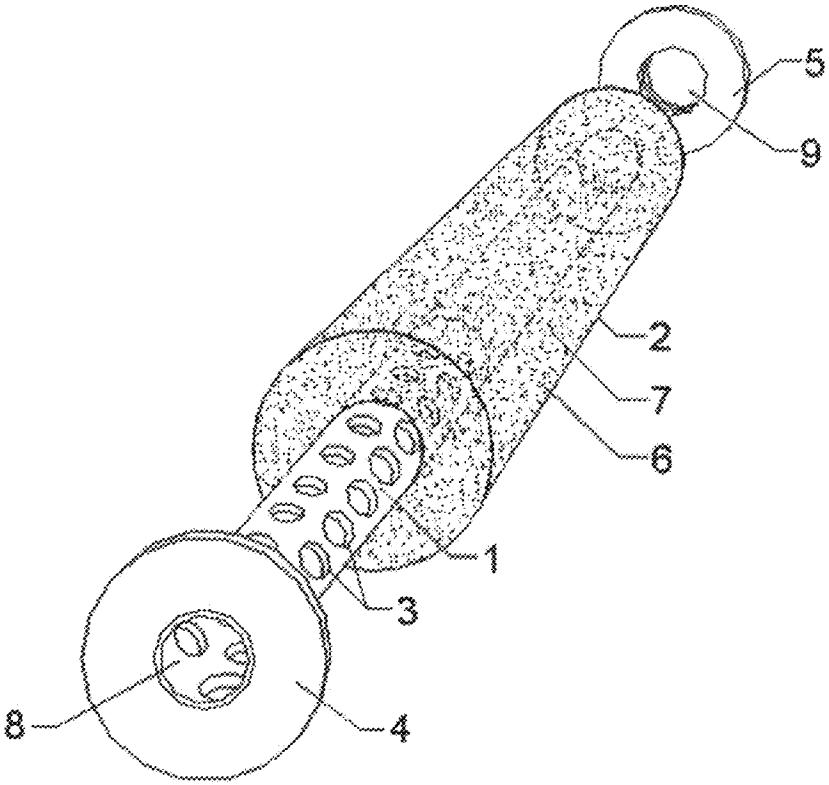
Figure 2A:
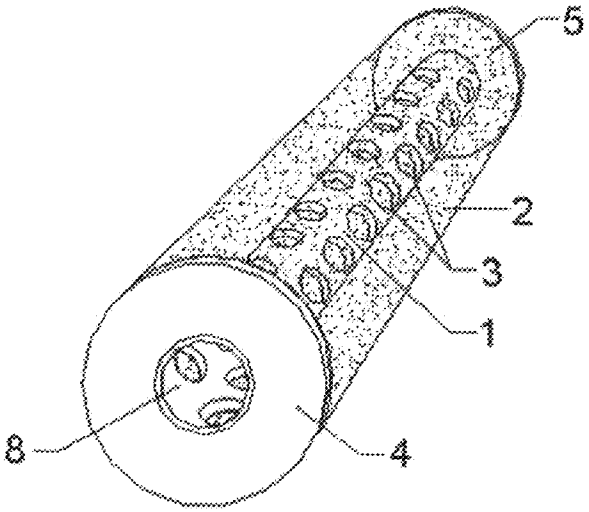

FIG. 2*a*: A view of the device shown in FIG. 1.

FIG. 2*b*: An exploded view of the device shown in FIG. 2*a*

Figure 2C:
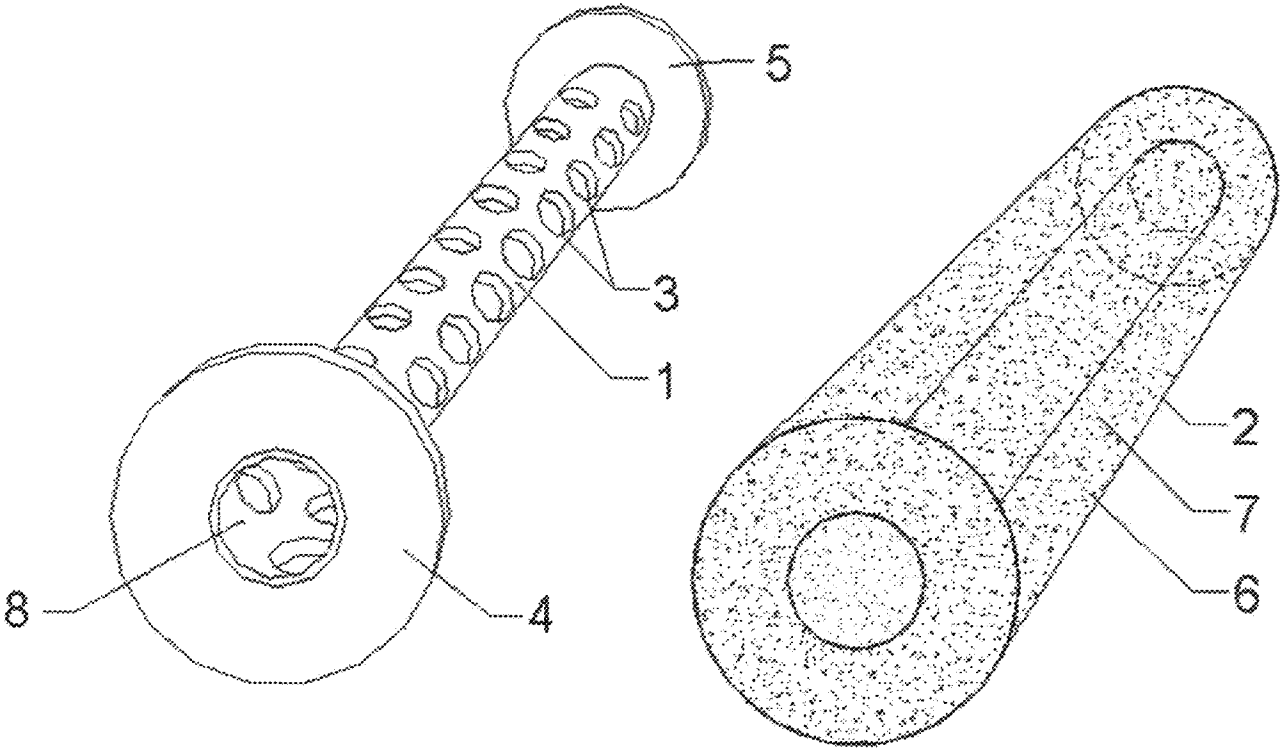

FIG. 2*c*: The device in FIG. 2*a* with the containment cap and the muzzle connection cap separated from the porous micro-channel diffusion matrix.

Figure 3:
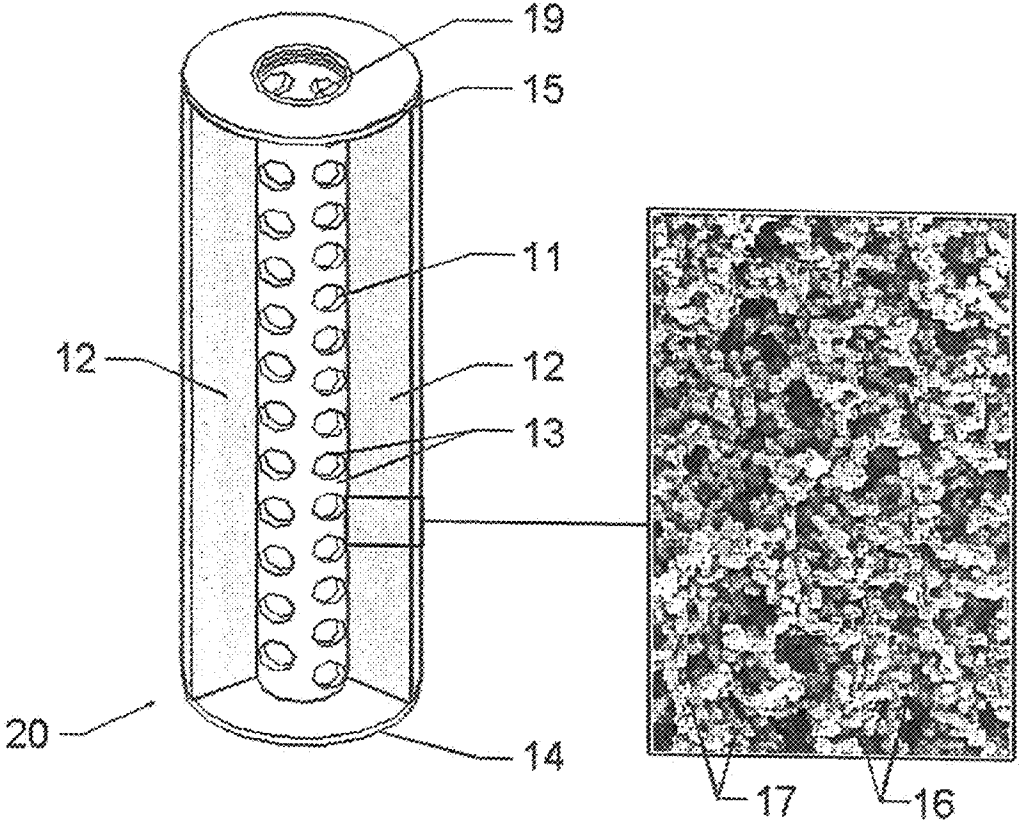

FIG. 3: A cut out view of an embodiment of the suppressor device displaying a porous micro-channel diffusion matrix comprised of a polymer material.

Figure 4:
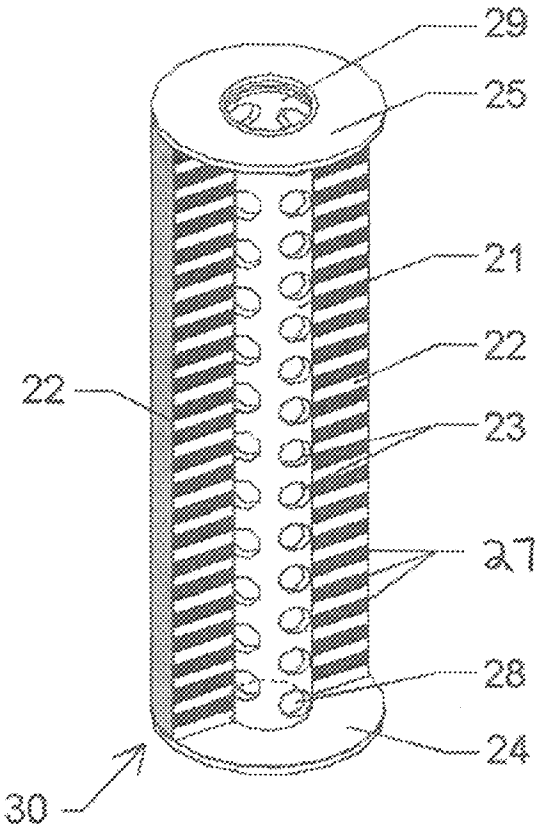

FIG. 4: A cut out view of an embodiment of the suppressor device with the addition of baffles to the porous micro-channel diffusion matrix.

Figure 5:
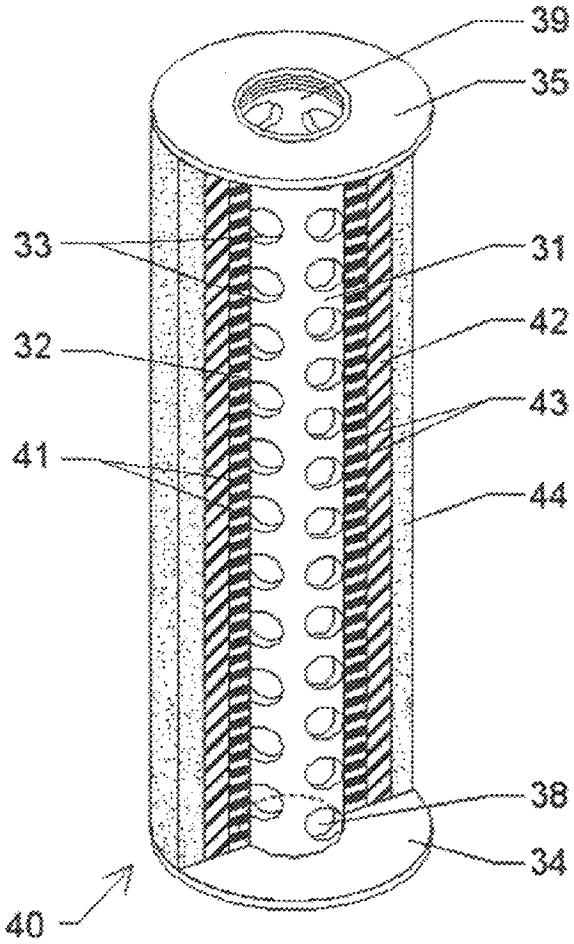

FIG. 5: A cut out of an embodiment of the suppressor device with the addition of multiple layers of the porous micro-channel diffusion matrix.

Figure 6:
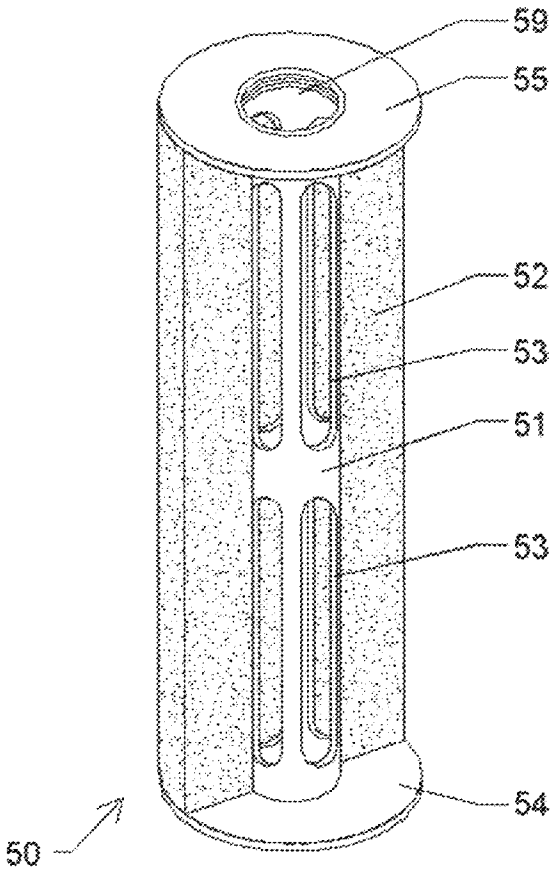

FIG. 6: A cut out view of an embodiment illustrating an alternative hollow core tube.

Figure 7:
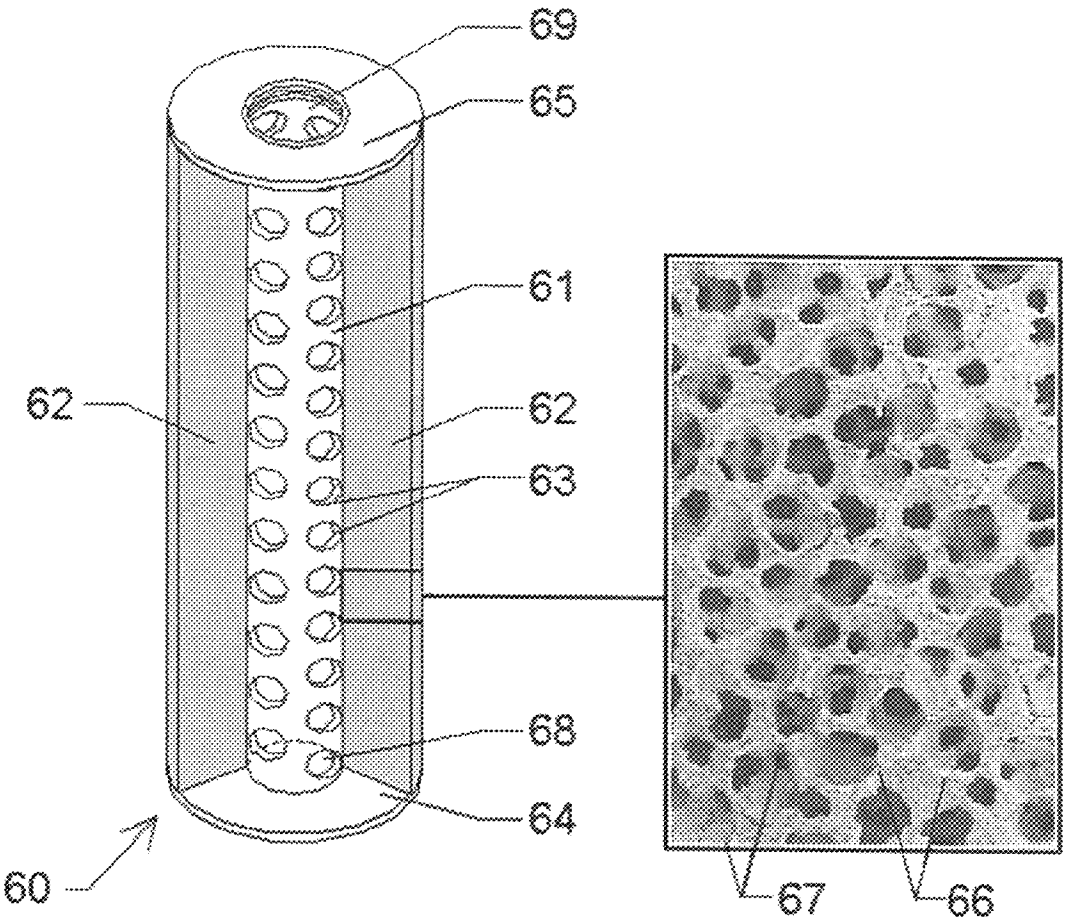

FIG. 7: A cut out view of an embodiment of the suppressor device displaying a porous micro-channel diffusion matrix comprised of a ceramic based material.

Figure 8:
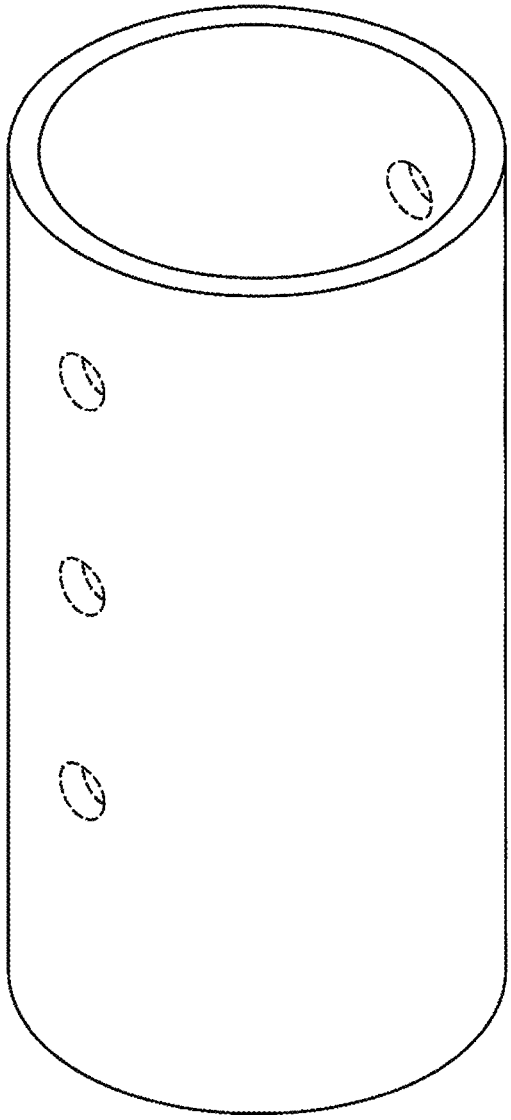

FIG. 8 is a schematic illustration of a sheath for partially or fully encapsulating the porous microchannel diffusion matrix of any of the suppressor devices shown in FIGS. 1-7, with optional openings shown in broken lines.

DETAILED DESCRIPTION

Firearm suppressors are used to reduce the muzzle flash and the audible sound associated with the discharge of a firearm. However traditional suppressors also have negative effects. Most suppressors change the point of impact; add significant weight to the firearm; increase the blow back; change the recoil; increase the barrel temperature resulting in the perceived mirage effect and decreasing the effectiveness and shorted barrel lifetime, and are difficult to clean. Traditional suppressors also have complex designs such as inner baffling. The intricate designs of traditional suppressors increase their cost of manufacturing. The embodiments disclosed here minimize these negative effects.

FIG. 1 shows suppressor device 10 comprised of hollow core tube 1 within porous micro-channel diffusion matrix 2. Hollow core tube 1 is comprised of circular vents 3. In some embodiments the ends of the hollow core tube may threaded. Hollow core tube 1 is connected by the use of threads or other means of attachment to muzzle attachment cap 4 with muzzle opening 8 (seen more clearly in FIG. 2) and to containment cap 5 with central aperture 9. Muzzle opening 8 and central aperture 9 may be threaded to facilitate attachment. Muzzle attachment cap 4 and containment cap 5 may alternatively be conical shaped. Porous micro-channel diffusion matrix 2 is comprised of pores 6 and micro-channel structure 7. In this embodiment, the porous micro-channel diffusion matrix 2 comprised of a metallic material and the median pore diameter is comprised of a range of about 20-2000 μm.

The micro-channel design acts as an outer diffusion matrix that exponentially increases the surface area of the suppressor device and allows combustion gasses to diffuse and exit the suppressor device across the entire outer surface of the suppressor device. Having an outer micro-channel diffusion matrix allows for the use of a "hollow core tube", rather the traditional core tube comprised of a series of inner baffles forming a central aperture that allows for passage of the bullet. The vented hollow core tube in a suppressor is a novel design and is feasible because of the use of the micro-channel matrix that acts as a baffle system along the outer, rather than the inner, surface of the device.

FIG. 2 shows an exploded view of device 10. Hollow core tube 1 is comprised of circular vents 3 and muzzle end cap 4 with muzzle opening 8 and containment cap 5 with central aperture 9 (as seen in FIG. 1). Porous micro-channel diffusion matrix 2 can be releasably engaged with hollow core tube 1. When engaged, porous micro-channel diffusion matrix 2 completely surrounds hollow core tube 1. The circular vents 3 allow gasses produced by a firearm discharge to pass through the hollow core tube 1 and enter the porous micro-channel diffusion matrix 2 where porous micro-channel diffusion matrix 2 acts as a medium by which the gasses produced by the gunshot will be impeded. Containment cap 5 secures porous micro-channel diffusion matrix 2 to hollow core tube 1 preventing porous micro-channel diffusion matrix 2 from unintended separation.

FIG. 3 shows suppressor device 20 comprised of hollow core tube 11 within porous micro-channel diffusion matrix 12. Hollow core tube 11 is hollow comprised of circular vents 13 and muzzle connection cap 14 with muzzle opening (not shown) and containment cap 15 with central aperture 19, porous micro-channel diffusion matrix 12 is comprised of pores 16 and micro-channel structure 17. In this embodiment, the porous micro-channel diffusion matrix 12 is comprised of a polymer material with a median pore diameter of a range of about 20-2000 μm. The porous micro-channel diffusion matrices can be comprised of polymers including but not limited to polyethylene, polypropylene, polycarbonate, nylon, polydietherketon, and thermoplastic elastomers.

FIG. 4 shows suppressor device 30 comprised of hollow core tube 21 within porous micro-channel diffusion matrix 22. Hollow core tube 21 is comprised of circular vents 23 and muzzle connection cap 24 with a muzzle opening 28 and containment cap 25 with central aperture 29 porous micro-channel diffusion matrix 22 is comprised of pores formed by a matrix (not shown in detail) and is further comprised of baffles 27. Baffles 27 further enhance the flow of gasses out of the device. In this embodiment, solid baffles 27 are perpendicular to the length of the cylindrical shape of the suppressor. However, baffles can be set at any angle and can be solid or semisolid in nature. In some embodiments the baffles may be circular in shape.

FIG. 5 shows suppressor device 40 comprised of hollow core tube 31 within multiple layers of porous micro-channel diffusion matrices including inner porous micro-channel diffusion matrix 32, porous micro-channel middle diffusion matrix 42, and outer porous micro-channel diffusion matrix 44. The diffusion matrices can each be a specific composition, for example they can be metallic, polymer, ceramic or elastomeric or a mixture of one or more metals, polymers, ceramics or elastomers. Hollow core tube 31 is hollow comprised of circular vents 33 and muzzle connection cap 34 with a muzzle opening 38 and containment cap 35 with central aperture 39. Inner porous micro-channel diffusion matrix 32 is comprised of pores formed by matrix (not shown in detail) and is further comprised of solid baffles 41 set perpendicularly. Middle porous micro-channel diffusion matrix 42 is comprised of pores formed by a matrix (not shown in detail) and is further comprised of solid partitions 43 set approximately at a forty-five degree angle. Outer porous micro-channel diffusion matrix 44 is solely comprised of pores formed by a matrix (not shown in detail). This is an exemplary design. The invention contemplates any plurality of layers of porous micro-channel middle diffusion matrices with any combinations of porous micro-channel matrix compositions and structures, with or without baffles.

FIG. 6 shows suppressor device 50 comprised of hollow core tube 51 within porous micro-channel diffusion matrix 52. Hollow core tube 51 is comprised of oval vents 53 and muzzle connection cap 54 with muzzle opening (not shown) and containment cap 55 with central aperture 59. Porous micro-channel diffusion matrix 52 is comprised of pores formed by a matrix (not shown in detail). The matrix of the porous micro-channel diffusion matrix can have a median pore diameter of 20-2000 μm and can be made out of polymer, metal, elastomeric, or ceramic materials (or a layered combination thereof).

FIG. 7 shows suppressor device 60 comprised of hollow core tube 61 within porous micro-channel diffusion matrix 62. Hollow core tube 61 is comprised of circular vents 63 and muzzle connection cap 64 with muzzle opening 68 and containment cap 65 with central aperture 69. Porous micro-channel diffusion matrix 62 is comprised of pores 66 and micro-channel structure 67. In this embodiment, porous micro-channel diffusion matrix 62 is comprised of ceramic materials and can have a median pore diameter of 20-2000 μm.

The three-dimensional, micro-channel structure in all the embodiments gives the device strength while minimizing density to help drastically reduce weight. Preferably the pore diameters range from 20-2000 μm and the porosity ranges from 5-95%. However, the precise pore size, porosity, outside diameter, inside diameter, length and number of micro-channel layers ultimately depends on the caliber of the firearm and the resulting pressurized discharge of the cartridge. Controlling these parameters allows the device to be tailored precisely to each application by altering the surface area (porosity) and resistance (pore size) through which the gasses need to pass. Preferred embodiments of the invention may be further comprised of an elastomeric or metallic sleeve surrounding the porous micro-channel diffusion matrix. This sleeve can be woven, cross-drilled, slotted, or solid in nature (not shown).

Because of the simplicity of the design, manufacturing of the porous micro-channel diffusion matrix can be done by any means known in the art, but is not limited to, polymer, elastomeric, or ceramic sintering. Metallic porous micro-channel matrices can be manufactured by any means known in the art of metallic sintering or foaming but is not limited to known methods. The ease of manufacturer allows for a decreased cost, thereby the matrix can be easily replaced; eliminating the hassle of cleaning the suppressor.

The foregoing description merely illustrates the invention and is not intended to be limiting. It will be apparent to those skilled in the art that various modifications can be made without departing from the inventive concept. Accordingly it is not intended that the invention be limited except by the appended claims.

The invention claimed is:

1. A suppressor for use with a firearm configured to fire a round of ammunition including a projectile along a projectile path, the suppressor comprising:

a porous diffusion matrix formed of sintered polymer to have an internal passage sized and shaped to receive the projectile through the porous diffusion matrix, the porous diffusion matrix having an exterior surface and an interior surface, the interior surface being in the internal passage, the sintered polymer forming pores opening at the interior surface and at the exterior surface and channels within the porous diffusion matrix placing at least some of the pores opening at the interior surface in fluid communication with the pores opening at the exterior surface;

a muzzle connection cap operatively attached to the porous diffusion matrix, the muzzle connection cap being configured for mounting the porous diffusion matrix on a muzzle of the firearm such that the internal passage is aligned with the muzzle.

2. The suppressor of claim 1 wherein the sintered polymer comprises polymer particles held together by sintered bonds.

3. The suppressor of claim 2 wherein the pores and the channels are defined in the diffusion matrix between the sintered polymer particles.

4. The suppressor of claim 1 wherein the porous diffusion matrix consists essentially of the sintered polymer.

5. The suppressor of claim 1 wherein the diffusion matrix has a porosity in a range of from 5% to 95%.

6. The suppressor of claim 1 wherein the pores formed in the diffusion matrix have a median pore diameter of from 20 μm to 2000 μm.

* * * * *